US011179959B2

(12) United States Patent
Yu et al.

(10) Patent No.: US 11,179,959 B2
(45) Date of Patent: Nov. 23, 2021

(54) SECURITY ELEMENT WITH A METALLIZED STRUCTURED SURFACE

(71) Applicant: 3M INNOVATIVE PROPERTIES COMPANY, St. Paul, MN (US)

(72) Inventors: Ta-Hua Yu, Woodbury, MN (US); William Blake Kolb, Stillwater, MN (US); Douglas S. Dunn, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/362,330

(22) Filed: Mar. 22, 2019

(65) Prior Publication Data

US 2019/0299700 A1 Oct. 3, 2019

Related U.S. Application Data

(60) Provisional application No. 62/648,555, filed on Mar. 27, 2018.

(51) Int. Cl.

| | |
|---|---|
| ***B42D 25/328*** | (2014.01) |
| ***B42D 25/373*** | (2014.01) |
| ***B42D 25/324*** | (2014.01) |
| ***B42D 25/351*** | (2014.01) |
| ***B42D 25/47*** | (2014.01) |

(52) U.S. Cl.

CPC ..... *B42D 25/328* (2014.10); *B42D 25/324* (2014.10); *B42D 25/351* (2014.10); *B42D 25/373* (2014.10)

(58) Field of Classification Search

CPC ..... B42D 25/328
USPC ..... 283/67, 70, 72, 74, 94, 98
See application file for complete search history.

(56) References Cited

U.S. PATENT DOCUMENTS

| | | | | |
|---|---|---|---|---|
| 2005/0104364 | A1* | 5/2005 | Keller | B42D 25/369 283/72 |
| 2016/0170219 | A1* | 6/2016 | Fuhse | B42D 25/29 283/91 |
| 2018/0281502 | A1* | 10/2018 | Zhu | B42D 25/21 |

FOREIGN PATENT DOCUMENTS

| | | | | |
|---|---|---|---|---|
| CN | 1387231 | A | 12/2002 | |
| CN | 1452728 | A | 10/2003 | |
| CN | 1871531 | A | 11/2006 | |
| CN | 101368352 | A | 2/2009 | |
| CN | 106313934 | A | 1/2017 | |
| EP | 1271627 | A2 | 1/2003 | |
| EP | 2192428 | A1 | 6/2010 | |
| WO | WO 9740464 | A2 | 10/1997 | |
| WO | WO 01/75517 | | 10/2001 | |
| WO | WO 03053713 | A1 | 7/2003 | |
| WO | WO 2017/003870 | | 1/2017 | |
| WO | WO-2017092667 | A1 * | 6/2017 | B42D 25/328 |
| WO | WO 2018/017552 | A1 | 1/2018 | |

OTHER PUBLICATIONS

Extended Search Report, EP19164937.5, dated Sep. 17, 2019, 3 pages.

* cited by examiner

*Primary Examiner* — Justin V Lewis

(57) ABSTRACT

A security element, including: a substrate having a first structured major surface and a second structured major surface; and a first metal layer coated on the first structured major surface, wherein the transparency of the first metal layer is between 10% and 90%; and a second metal layer coated on the second structured major surface.

16 Claims, 1 Drawing Sheet

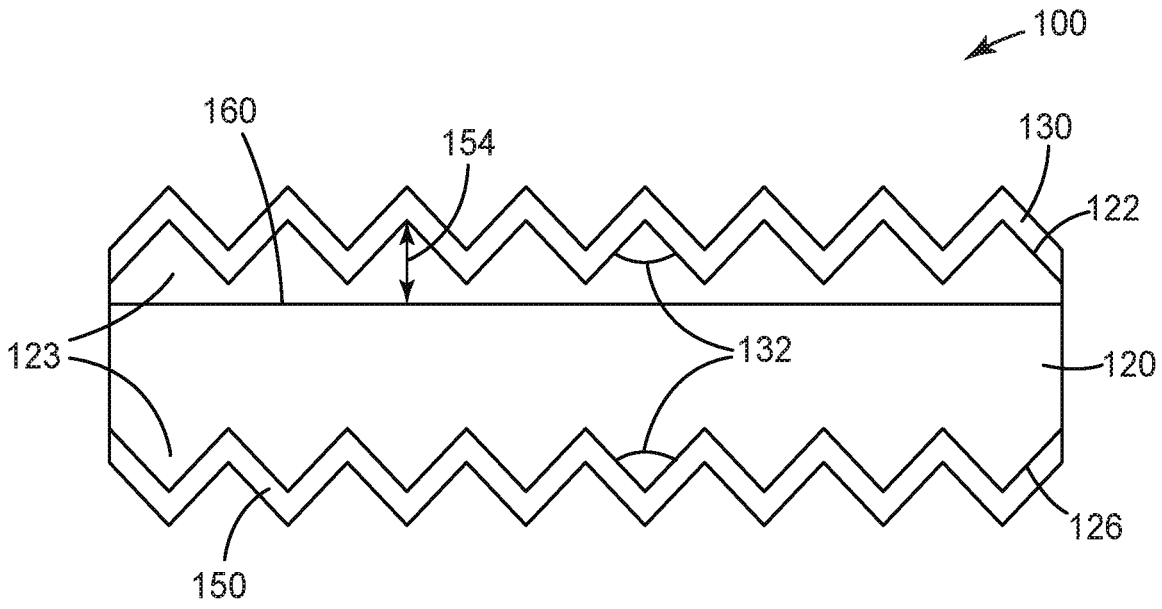
100
160
154
130
122
123
132
120
126
150

SECURITY ELEMENT WITH A METALLIZED STRUCTURED SURFACE

BACKGROUND

Product counterfeiting has been on the rise in many industries. For protection, valuable articles, such as branded articles, are often provided with security elements that permit the authenticity of the articles to be verified, and that simultaneously serve as protection against unauthorized reproduction. Security elements play a special role in safeguarding authenticity, as these cannot be reproduced even with the most modern copiers. However, there is a need for better security element.

SUMMARY

Thus, in one aspect, the present disclosure provides a security element, comprising: a substrate having a first structured major surface and a second structured major surface; and a first metal layer coated on the first structured major surface, wherein the transparency of the first metal layer is between 10% and 90%; and a second metal layer coated on the second structured major surface.

In another aspect, the present disclosure provides a method, comprising: providing the security element of current application; and obtaining a reflective diffraction pattern from the security element.

Various aspects and advantages of exemplary embodiments of the present disclosure have been summarized. The above Summary is not intended to describe each illustrated embodiment or every implementation of the present disclosure. Further features and advantages are disclosed in the embodiments that follow. The Drawings and the Detailed Description that follow more particularly exemplify certain embodiments using the principles disclosed herein.

BRIEF DESCRIPTION OF THE DRAWINGS

The disclosure may be more completely understood in consideration of the following detailed description of various embodiments of the disclosure in connection with the accompanying figures, in which:

FIG. 1 is a schematic side view of one embodiment of security element.

While the above-identified drawings, which may not be drawn to scale, set forth various embodiments of the present disclosure, other embodiments are also contemplated, as noted in the Detailed Description. In all cases, this disclosure describes the presently disclosed invention by way of representation of exemplary embodiments and not by express limitations. It should be understood that numerous other modifications and embodiments can be devised by those skilled in the art, which fall within the scope and spirit of this disclosure.

DETAILED DESCRIPTION

Before any embodiments of the present disclosure are explained in detail, it is understood that the invention is not limited in its application to the details of use, construction, and the arrangement of components set forth in the following description. The invention is capable of other embodiments and of being practiced or of being carried out in various ways that will become apparent to a person of ordinary skill in the art upon reading the present disclosure. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. It is understood that other embodiments may be utilized and structural or logical changes may be made without departing from the scope of the present disclosure.

As used in this Specification, the recitation of numerical ranges by endpoints includes all numbers subsumed within that range (e.g. 1 to 5 includes 1, 1.5, 2, 2.75, 3, 3.8, 4, and 5, and the like).

Light transmission characteristic of a security element is described as transparency. The transparency of a security element is normally measured by its total transmittance. Total transmittance is the ratio of transmitted light to the incident light. There are two influencing factors; reflection and absorption. For example: Incident light=100%−(Absorption=−1%+Reflection=−5%)=Total Transmittance=94%. The total transmittance of a regular glass slide is about 92%. Metallization can reduce total transmittance significantly which is mainly due to absorption behavior of metal coating and dependent on metal coating thickness. For example, the total transmittance of a glass slide coated with 100 nm silver is less than 1%. The total transmittance of a glass slide coated with 10 nm silver is about 69%.

Unless otherwise indicated, all numbers expressing quantities or ingredients, measurement of properties and so forth used in the Specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

There is an increased need for security elements to permit the authenticity of the articles to be verified, for example, branded articles. The present application provides a security element to, which can be used to verify the authenticity of the articles.

FIG. 1 is a schematic side view of one embodiment of security element 100. The security element 100 includes a substrate 120. The substrate 120 includes a first structured major surface 122 and a second structured major surface 126. The first structured major surface 122 and a second structured major surface 126 can include a plurality of features 123. The security element 100 may further include a first metal layer 130 on the first structured major surface 122 of the substrate 120. The security element 100 may further include a second metal layer 150 on the second structured major surface 126 of the substrate 120. In the embodiment of FIG. 1, the first or second metal layer can conform to the shape of features of the first or second structured major surface. Alternatively, in other embodiments, the first or second metal layer can have a first major surface to conform to the shape of features and a second flat major surface. In some embodiments, the transparency of the first metal layer can be between 10% and 90%, between 20% and 90%, between 30% and 90%, between 40% and 90%, or between 50% and 90%. In some embodiments, the transparency of the second metal layer can be less than 50%, less than 40%, less than 30%, less than 20%, less than 10%, or less than 5%. The security element 100 may further include an optional binder. In some embodiments, the first or second metal layer can be a continuous monolayer. In some embodiments, the first or second metal layer can be not patterned.

In some embodiments, the plurality of features 123 can be a plurality of microscale features. In some embodiments, the plurality of features 123 can be a plurality of nanoscale features. In some embodiments, the plurality of features 123 can be randomly arrayed features. In some embodiments, the randomly arrayed features can be randomly arrayed nanoscale features. In some embodiments, the plurality of microscale features or nanoscale features may be randomly arrayed features. In some embodiments, the plurality of features 123 can be orderly arrayed features. In some embodiments, the plurality of microscale features or nanoscale features may be ordered features. In some embodiments that the first or second structured major surface include a plurality of both microscale features and nanoscale features, at least part of the nanoscale features may be formed on the microscale features. In some embodiments, the first or second structured major surface may include both ordered microscale features and randomly arrayed nanoscale features. In some embodiments, microscale features or nanoscale features may be microreplicated features. In some embodiments, microscale features or nanoscale features may be linear prisms.

In some embodiments, the nanoscale features have a high aspect ratio (the ratio of height to width). In some embodiments, aspect ratio (the ratio of height to width) of the nanoscale features is 1:1, 2:1, 4:1, 5:1, 8:1, 10:1, 50:1, 100:1, or 200:1. In some embodiments, aspect ratio (the ratio of height to width) of the nanoscale features can be more than 1:1, 2:1, 4:1, 5:1, 8:1, 10:1, 50:1, 100:1, or 200:1. Nanoscale features can be such as, for example, nano-pillars or nano-columns, or continuous nano-walls comprising nano-pillars or nano-columns. In some embodiments, the nanoscale features have steep side walls that are substantially perpendicular to the substrate. In some embodiments, the majority of the nanoscale features can be capped with mask material.

In the embodiment as shown in FIG. 1, the features are linear prismatic features. Each linear prismatic features 123 includes an apex angle 132 and a height 154 measured from a common reference plane such as, for example, major plane surface 160, In some cases, such as when it is desirable to reduce optical coupling, or wet-out, some of the linear prismatic features are shorter and some of the linear prismatic features are taller. Apex or dihedral angle 132 can have any value that may be desirable in an application. For example, in some cases, apex angle 132 can be in a range from about 70 degrees to about 110 degrees, or from about 80 degrees to about 100 degrees, or from about 85 degrees to about 95 degrees. In some cases, microstructures 123 have equal apex angles which can, for example, be in a range from about 88 or 89 degrees to about 92 or 91 degrees, such as 90 degrees.

Substrate may include any of a wide variety of non-polymeric materials, such as glass, or various thermoplastic and crosslinked polymeric materials, such as polyethylene terephthalate (PET), polyethylene naphthalate (PEN), (e.g. bisphenol A) polycarbonate, cellulose acetate, poly(methyl methacrylate), and polyolefins such as biaxially oriented polypropylene, cyclic olefin polymer (COP), and cyclic olefin copolymer (COP) which are commonly used in various optical devices. In some embodiments, the substrate may be removable substrate.

The first or second metal layer can be formed from a variety of materials including, for example, individual metals, multilayer metals, two or more metals as mixtures, inter-metallics or alloys, semi-metals or metalloids, metal oxides, metal and mixed metal oxides, metal and mixed metal fluorides, metal and mixed metal nitrides, metal and mixed metal carbides, metal and mixed metal carbonitrides, metal and mixed metal oxynitrides, metal and mixed metal borides, metal and mixed metal oxy borides, metal and mixed metal silicides, diamond-like carbon, diamond-like glass, graphene, and combinations thereof. Exemplary individual metals can include Au, Ag, Pt, Cu, Al and Cr. Exemplary metal oxides include silicon oxides such as silica, aluminum oxides such as alumina, titanium oxides such as titania, indium oxides, tin oxides, indium tin oxide (ITO), tantalum oxide, zirconium oxide, niobium oxide, and combinations thereof. Other exemplary materials include boron carbide, tungsten carbide, silicon carbide, aluminum nitride, silicon nitride, boron nitride, aluminum oxynitride, silicon oxynitride, boron oxynitride, zirconium oxyboride, titanium oxyboride, and combinations thereof.

The binder can be an organic binder. Examples of suitable organic binders that are useful in abrasive composites include phenolics, aminoplasts, urethanes, epoxies, acrylics, cyanates, isocyanurates, glue, and combinations thereof. In some embodiments, the binder can include acrylic acid polymer, methyl acrylate, methyl methacrylate and acrylic acid 2-ethyl hexyl fat, initiator comprises benzophenone, related aminobenzophenones di ethylaluminium, colorless crystal violet, toluene sulfonic acid-hydrate and diamond GH malachite green, 9G comprises a photopolymerizable monomer, APG-400 and the BPE-500, the solvent comprises methyl ethyl ketone.

The substrate 120 can have any index of refraction that may be desirable in an application. For example, in some cases, the index of refraction of the substrate is in a range from about 1.4 to about 1.8, or from about 1.5 to about 1.8, or from about 1.5 to about 1.7. In some cases, the index of refraction of the substrate is not less than about 1.5, or not less than about 1.55, or not less than about 1.6, or not less than about 1.65, or not less than about 1.7.

The security element of current application can be used as an identification feature for security and authentication applications, for example, an anti-counterfeit label, an authentication tape, or an identification feature for document authentication, license plate, driver license, passport and currency, advanced food, pharmaceutical and healthcare packaging. The security element can display a unique reflective diffraction pattern, for example, sharp spectral lines and/or dots. A method to verify the authenticity of an article is describe. The method can include providing the security element of current application and obtaining a reflective diffraction pattern from the security element. The method can further include determining the authenticity based on the reflective diffraction pattern, for example by the user's eye, or visible light detection apparatus. In some embodiments, the reflective diffraction pattern can be obtained by applying a laser to the security element.

The following embodiments are intended to be illustrative of the present disclosure and not limiting.

EMBODIMENTS

Embodiment 1 is a security element, comprising: a substrate having a first structured major surface and a second structured major surface; and a first metal layer coated on the first structured major surface, wherein the transparency of the first metal layer is between 10% and 90%; and a second metal layer coated on the second structured major surface.

Embodiment 2 is the security element of embodiment wherein the transparency of the second metal layer is less than 50%.

Embodiment 3 is the security element of any one of embodiments 1 to 2, wherein the first or second metal layer is a continuous monolayer.

Embodiment 4 is the security element of any one of embodiments 1 to 3, wherein the first or second metal layer is not patterned.

Embodiment 5 is the security element of any one of embodiments 1 to 4, wherein the first or second structured major surface comprises a plurality of features.

Embodiment 6 is the security element of embodiment 5, wherein the plurality of features are nanoscale features.

Embodiment 7 is the security element of embodiment 5, wherein the plurality of features are randomly arrayed features.

Embodiment 8 is the security element of embodiment 7, wherein the randomly arrayed features are randomly arrayed nanoscale features.

Embodiment 9 is the security element of embodiment 5, wherein the plurality of features are orderly arrayed features.

Embodiment 10 is the security element of embodiment 5, wherein the plurality of features comprise microscale features and nanoscale features.

Embodiment 11 is the security element of embodiment 5, wherein the plurality of features comprise ordered microscale features and randomly arrayed nanoscale features.

Embodiment 12 is the security element of embodiments 10-11, wherein the nanoscale features are formed on the microscale features.

Embodiment 13 is the security element of embodiments 1-12, further comprising a binder.

Embodiment 14 is the security element of embodiments 1-13, wherein the first or second metal layer comprises individual metals, multilayer metals, two or more metals as mixtures, inter-metallics or alloys, semi-metals or metalloids, metal oxides, metal and mixed metal oxides, metal and mixed metal fluorides, metal and mixed metal nitrides, metal and mixed metal carbides, metal and mixed metal carbonitrides, metal and mixed metal oxynitrides, metal and mixed metal borides, metal and mixed metal oxy borides, metal and mixed metal silicides, diamond-like carbon, diamond-like glass, graphene, and combinations thereof.

Embodiment 15 is the security element of embodiment 14, wherein the individual metals are selected from the group of Au, Ag, Pt, Cu, Al and Cr.

Embodiment 16 is the security element of embodiments 1-15, wherein the security element is an anti-counterfeit label.

Embodiment 17 is a method, comprising:

providing the security element of embodiments 1-16; and obtaining a reflective diffraction pattern from the security element.

Embodiment 18 is the method of embodiment 17, further comprising determining the authenticity based on the reflective diffraction pattern.

Embodiment 19 is the method of embodiment 18, wherein determining the authenticity comprises determine the pattern by the user's eye, or visible light detection apparatus.

Embodiment 20 is the method of embodiments 1-19, wherein obtaining the reflective diffraction pattern comprises applying a laser to the security element.

EXAMPLES

The following Examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Unless otherwise noted, all parts, percentages, ratios, and the like in the Examples and the rest of the specification are provided on the basis of weight. Solvents and other reagents used may be obtained from Sigma-Aldrich Chemical Company (Milwaukee, Wis.) unless otherwise noted.

Test Methods:

The following test methods were used to characterize sputtered silver coating and assembled articles.

Method 1: Ceramic Coating Thickness

The ceramic coating thickness was measured indirectly using a Veeco Dektak profilometer (Veeco Instruments, Plainview, N.Y.). Kapton tape was applied on and partially covering the surface of a glass slide. After coating the ceramic on the covered and uncovered surface of the glass slide using PVD (Sputtering), the tape was removed from the glass slide, and the coating thickness was determined from the step change observed when scanning the stylus probe of the Veeco Dektak contact profilometer across the coated and uncoated surface of the glass slide.

Method 2: Reflective Diffraction Pattern

A laser beam from a laser pointer is pointed on the surface of the article and the reflective diffraction pattern is projected on to a paper, Post-it, or any substrate that can used as a projection screen. The distance between the laser point and the surface of the article can be from couples of centimeter to tens of centimeter. The angle of the incident laser beam to the surface of the article can be from 5 degree to 75 degree. The reflective diffraction patterns can be visualized on the projection screen.

Example 1

A coating of metallic silver was sputtered from a 76.2 mm round silver target in a batch vacuum sputter coater. 3M™ Brightness Enhancement Film (BEF) was placed on a substrate holder set up inside a vacuum chamber with a sputtering metal target located at a height of 228.6 mm above the substrate holder. The micro-prism surface of the BEF was facing the sputtering target. After the vacuum chamber was evacuated to $2\times10^{-5}$ torr base pressure, argon was admitted inside the chamber and the total pressure of the vacuum chamber was adjusted to 3 millitorr. Sputtering was initiated using a DC power supply at a constant power level of 0.5 kilowatts until the coating thickness reached 100 nm.

Example 2

A coating of metallic silver was sputtered from a 76.2 mm round silver target in a batch vacuum sputter coater. 3M™ Brightness Enhancement Film (BEF) was placed on a substrate holder set up inside a vacuum chamber with a sputtering metal target located at a height of 228.6 mm above the substrate holder. The micro-prism surface of the BEF was facing the sputtering target. After the vacuum chamber was evacuated to $2\times10^{-5}$ torr base pressure, argon was admitted inside the chamber and the total pressure of the vacuum chamber was adjusted to 3 millitorr. Sputtering was initiated using a DC power supply at a constant power level of 0.5 kilowatts until the coating thickness reached 10 nm.

Example 3

3M Optically Clear Adhesive 8211 was applied onto the metallized micro-prism surface of the sample from Example 1. The non-metallized side of the sample from Example 2 was then laminated onto the adhesive with the long axis of the micro-prisms of the sample from Example 2 perpendicular to the long axis of the micro-prism of the sample from Example 1. A composited reflective diffraction pattern having a dotted radial arc and a dotted straight line was observed by Test Method #2.

Example 4

A microstructured film comprising spherical microlens arrays was obtained from MNTech Co. Ltd. (South Korea). This film was placed on a substrate holder set up inside a vacuum chamber with a sputtering metal target located at a height of 228.6 mm above the substrate holder. The spherical microlens arrays of the film were facing the sputtering target. After the vacuum chamber was evacuated to $2\times10^{-5}$ torr base pressure, argon was admitted inside the chamber and the total pressure of the vacuum chamber was adjusted to 3 millitorr. Sputtering was initiated using a DC power supply at a constant power level of 0.5 kilowatts until the coating thickness reached 10 nm.

Example 5

3M Optically Clear Adhesive 8211 was applied onto the metallized micro-prism surface of the sample from Example 1. The non-metallized side of the sample from Example 4 was then laminated onto the adhesive. A composited reflective diffraction pattern of multiple dotted radial arcs from the resulted article was observed by Test Method #2.

All references and publications cited herein are expressly incorporated herein by reference in their entirety into this disclosure. Illustrative embodiments of this invention are discussed and reference has been made to possible variations within the scope of this invention. For example, features depicted in connection with one illustrative embodiment may be used in connection with other embodiments of the invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A security element, comprising:

a substrate having a first structured major surface and a second structured major surface; and a first metal layer coated on the first structured major surface, wherein a transparency of the first metal layer is between 10% and 90%; wherein the first metal layer is a continuous monolayer;

a second metal layer coated on the second structured major surface;

wherein the first or second metal layer is not patterned;

wherein the first or second structured major surface comprises a plurality of features; and wherein the plurality of features in the first or second structured major surface are randomly arrayed features.

2. The security element of claim 1, wherein a transparency of the second metal layer is less than 50%.

3. The security element of claim 1, wherein the second metal layer is a continuous monolayer.

4. The security element of claim 1, wherein the plurality of features are nanoscale features.

5. The security element of claim 1, wherein the randomly arrayed features are randomly arrayed nanoscale features.

6. The security element of claim 1, wherein the plurality of features comprise microscale features and nanoscale features.

7. The security element of claim 6, wherein the nanoscale features are formed on the microscale features.

8. The security element of claim 1, wherein the plurality of features comprise ordered microscale features and randomly arrayed nanoscale features.

9. The security element of claim 1, further comprising a binder.

10. The security element of claim 1, wherein the first or second metal layer comprises individual metals, multilayer metals, two or more metals as mixtures, inter-metallics or alloys, semi-metals or metalloids, metal oxides, metal and mixed metal oxides, metal and mixed metal fluorides, metal and mixed metal nitrides, metal and mixed metal carbides, metal and mixed metal carbonitrides, metal and mixed metal oxynitrides, metal and mixed metal borides, metal and mixed metal oxy borides, metal and mixed metal silicides, and combinations thereof.

11. The security element of claim 10, wherein the individual metals are selected from the group of Au, Ag, Pt, Cu, Al and Cr.

12. The security element of claim 1, wherein the security element is an anti-counterfeit label.

13. A method, comprising:

providing the security element of claim 1; and obtaining a reflective diffraction pattern from the security element.

14. The method of claim 13, further comprising determining an authenticity based on the reflective diffraction pattern.

15. The method of claim 14, wherein the diffraction pattern can be observed visually, or determined with a visible light detection apparatus.

16. The method of claim 13, wherein obtaining the reflective diffraction pattern comprises applying a laser to the security element.

* * * * *